US006344138B1

(12) United States Patent
Del Guerra

(10) Patent No.: US 6,344,138 B1
(45) Date of Patent: Feb. 5, 2002

(54) DEVICE FOR REGENERATING THE COOLING EMULSION STAGNATING IN THE TANKS OF MACHINE TOOLS

(75) Inventor: Franco Del Guerra, Pomigliano d'Arco (IT)

(73) Assignee: TECC di Franco Del Guerra, Caivano (IT)

( * ) Notice: Subject to any disclaimer, the term of this patent is extended or adjusted under 35 U.S.C. 154(b) by 0 days.

(21) Appl. No.: 09/601,453

(22) PCT Filed: Jul. 6, 1999

(86) PCT No.: PCT/IT99/00206

§ 371 Date: Aug. 2, 2000

§ 102(e) Date: Aug. 2, 2000

(87) PCT Pub. No.: WO00/65003

PCT Pub. Date: Nov. 2, 2000

(30) Foreign Application Priority Data

Apr. 26, 1999 (IT) ..... NA99A0017

(51) Int. Cl.[7] ..... C02F 1/74

(52) U.S. Cl. ..... 210/168; 210/171; 210/220; 261/77; 261/124

(58) Field of Search ..... 210/168, 171, 210/172, 220; 261/77, 122.1, 124

(56) References Cited

U.S. PATENT DOCUMENTS 3,416,776 A * 12/1968 Gamer ..... 210/220
4,489,016 A * 12/1984 Kriebel ..... 261/124
4,581,137 A * 4/1986 Edwards et al. ..... 261/124
4,872,997 A 10/1989 Becker
5,772,871 A * 6/1998 Lyon et al. ..... 210/168
5,868,972 A * 2/1999 Galich et al. ..... 261/122.1

FOREIGN PATENT DOCUMENTS

| | | |
|---|---|---|
| DE | 37 16 806 | 12/1988 |
| DE | 40 00 126 | 7/1991 |
| DE | 298 16 516 | 1/1999 |
| EP | 0 926 227 | 6/1999 |
| WO | WO 92/19546 | 11/1992 |

* cited by examiner

*Primary Examiner*—Christopher Upton
(74) *Attorney, Agent, or Firm*—Young & Thompson

(57) ABSTRACT

A device for regenerating the cooling emulsion (3) stagnating in the tanks (2) of the machine tools, characterized in that the proliferation of anaerobic bacteria responsible for the evil-smelling deterioration of said emulsion (3) is suppressed by the use of a plurality of oxygenation pipes (1) submersed in the cooling liquid and capable of producing air microbubbles that ensure a sufficient and uniform oxygenation of the emulsion and avoid the formation of the typical, continuous lubricating oil layer above the coolant (3). Said oxygenating microbubbles causes also a continuous displacement of the cooling emulsion (3) that reduce the risk of dissociation of the emulsion itself.

Pipes (1) submersed in coolant (3) in tank (2) have holes (5) allowing internal pressurized air to escape regularly and to oxygenate cooling liquid (3).

Said pipes (1) are coated outside by a sponge rubber layer (4) made of a material resistant to the oil components of the emulsion so as to ensure a slow, homogeneous production of air microbubbles which bubble through the sponge rubber. Said microbubbles are formed by compressed air having a low pressure barely enough to cause air to escape regularly from pipes (1).

9 Claims, 2 Drawing Sheets

DEVICE FOR REGENERATING THE COOLING EMULSION STAGNATING IN THE TANKS OF MACHINE TOOLS

CROSS REFERENCE TO RELATED APPLICATION

This is the 35 U.S.C. 371 national stage of international application PCT/IT99/00206 filed on Jul. 6, 1999, which designated the United States of America.

FIELD OF THE INVENTION

The present invention relates to the mechanical industry and more particularly the machine tools.

BACKGROUND OF THE INVENTION

It is known that machine tools need cooling liquids to avoid the overheating of the tools during machining. Such cooling liquids (thereafter "coolants") are basically water emulsions comprising emulsifying oil and/or other lubricating means.

Machine tools are usually provided with at least a coolant tank and at least a recirculating pump that draws the coolant from the tank for supplying the same to the tool to be cooled.

A common problem in this field is given by the fast deterioration of such cooling emulsions. This is mainly due to the fact that coolant has generally a concentration of emulsifying oil ranging between 3 and 5% and is continuously in contact with the lubricating oil of the guides, the consumption of which in the current machine tools is about one and half litre a day.

Such lubricating oil is not recycled and is collected in the coolant tank with the result that a layer of lubricating oil is formed on the surface of the coolant in a few days, thus preventing the latter from being oxygenated and helping the fast proliferation of anaerobic bacteria that are the main cause of bad smells and fast deterioration of the emulsion itself.

Problems due to the removal of the lubricating oil from the surface of the cooling emulsion in the tank have been not solved effectively until today. An approach uses a suitable electric apparatus so-called oil separator.

A drawback of such oil separator is that not all the oil is recovered but a portion thereof sticks at the metal wall of the tank. If it is true that the service life of the emulsion is prolonged in this way, it is also true that the tank needs a careful maintenance after the replacement of the emulsion to avoid that the mould produced by the bacteria pollutes quickly the new cooling emulsion.

SUMMARY OF THE INVENTION

This invention seeks to overcome such drawbacks by providing a device to be installed in the tanks of the cooling liquid in the machine tools capable of preventing anaerobic bacteria from being formed and avoiding both the fast deterioration of the cooling emulsion and bad smell emission.

This is accomplished according to the invention by providing a device able to generate air microbubbles that guarantee the constant, uniform oxygenation of the cooling emulsion, particularly when the machine is still and the coolant is prone to become stagnant.

BRIEF DESCRIPTION OF THE DRAWINGS

A better understanding of the invention will result from the following detailed description with reference to the accompanying drawings that show some preferred embodiments thereof only by way of a not limiting example.

In the drawings.

DETAILED DESCRIPTION OF THE INVENTION

Figure 2:
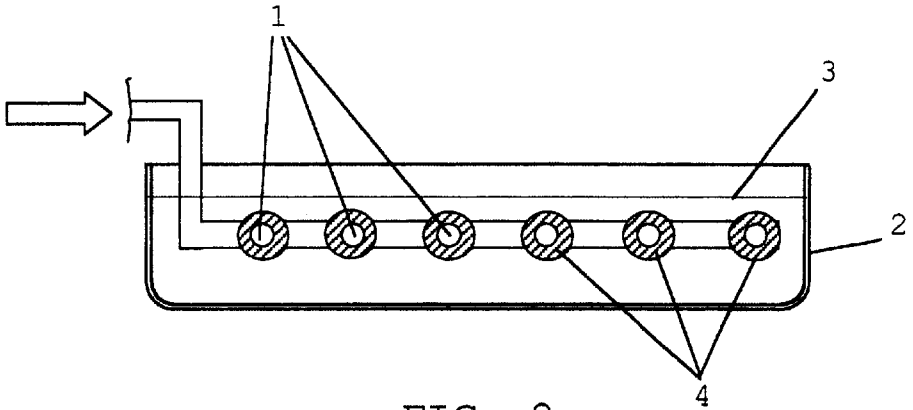
FIGS. 2 and 3 are a longitudinal section and a cross section of FIG. 1, respectively.

The device according to the invention operates essentially as an oxygenation device that increases the life time of the cooling emulsion in addition to the avoidance of the proliferation of anaerobic bacteria, and ensures a slight, continuous displacement which makes the oxygenation homogeneous.

With reference to the drawings listed above the device of the invention includes a plurality of pipes 1 submersed in coolant 3 of tank 2 and perforated so as to allow the internal pressurized air to escape regularly and to oxygenate liquid cooling medium 3. In the embodiment shown each such pipe has a closed end while the other end is connected to the compressed-air source.

According to a peculiar feature of the invention, such pipes are coated outside by a layer 4 made of sponge rubber withstanding the oil components of the emulsion which guarantees a slow, homogeneous production of air microbubbles. Such microbubbles consist of compressed air having a low pressure barely enough to cause air to escape regularly from pipes 1 that have holes 5 which are spread out therealong so that a suitable pressure is guaranteed from the nearest to the remote portions from the air source. In fact, it should be appreciated that the air escaping from pipes 1 as microbubbles does not perform any mechanical function or remove any deposit of any kind. It just bubbles through the emulsion to oxygenate it.

More specifically pipes 1 which are near the compressed-air source have a lower number of holes 5 than the number of holes 5 of remote pipes 1 so that the quantity of microbubbles produced by each pipe is the same throughout tank 3.

Figure 3:
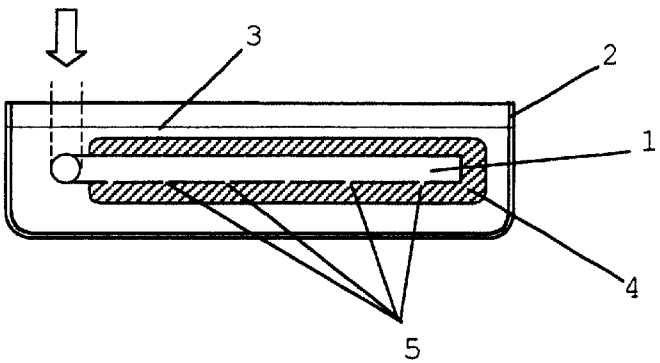
Figure 1:
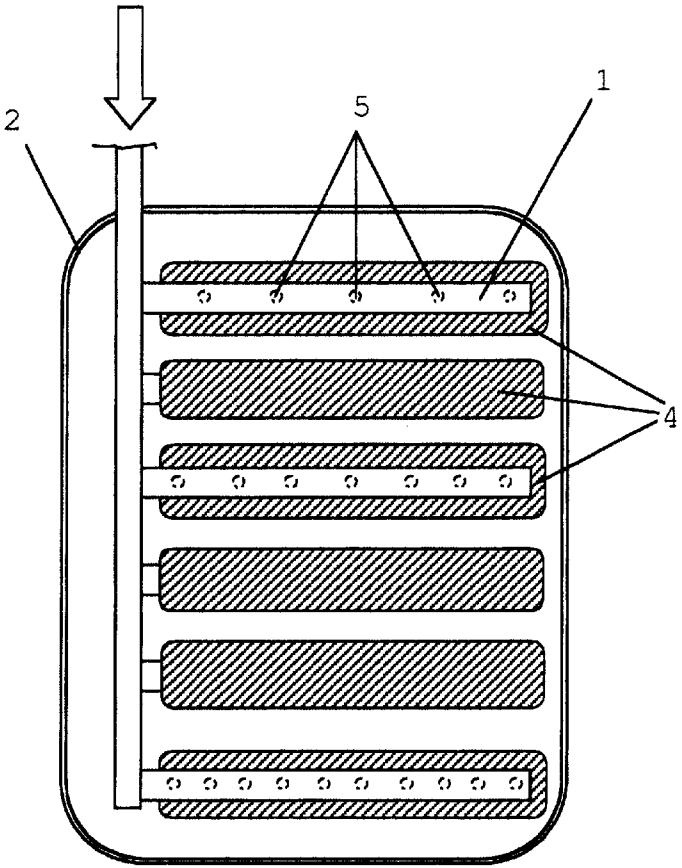
FIG. 1 is a top plan view of the device according to the invention installed in the tank of a machine tool, with partial sections of the oxygenation pipes.
Figure 4:
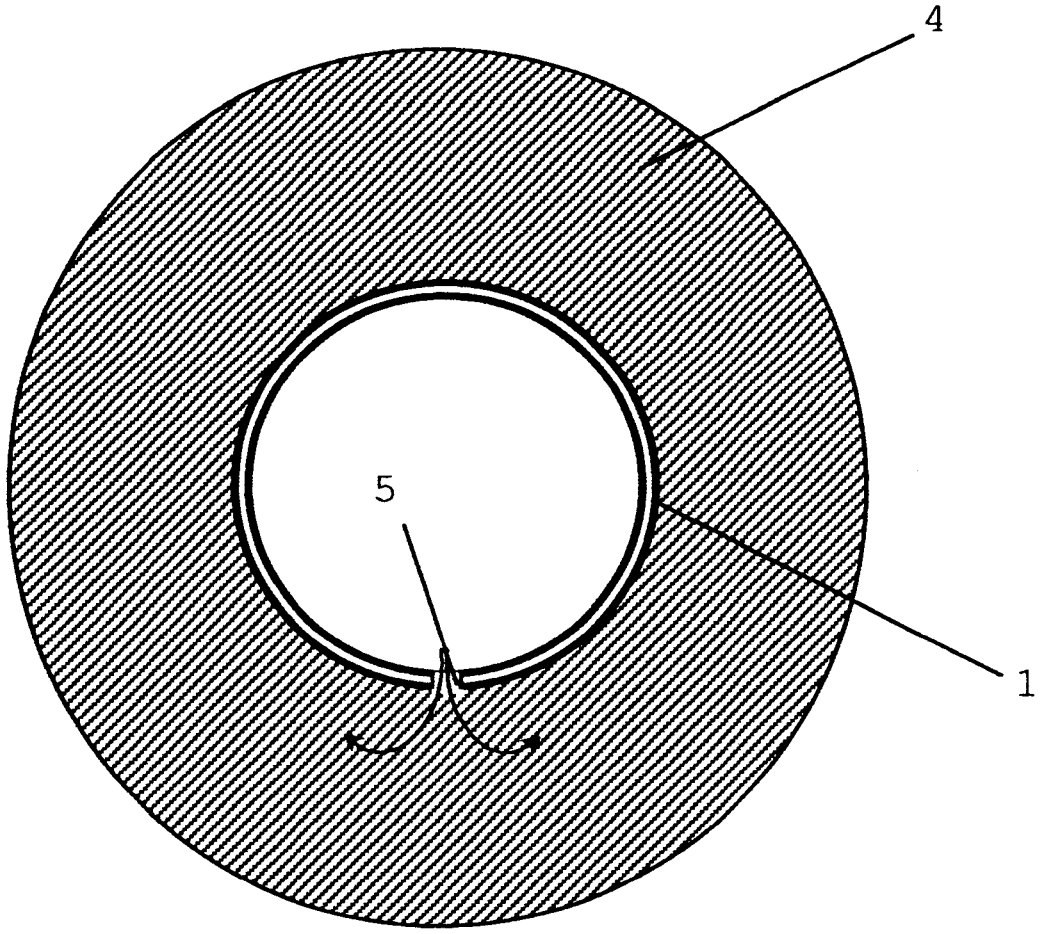
FIG. 4 is a cross section of an oxygenation pipe according to the invention.

With particular reference to FIG. 3, such holes 5, all having the same diameter, are located along the lower generatrix of each pipe 1 so that air escaping therefrom crosses almost all the sponge rubber coating 4 and establishes an uniform spreading of microbubbles all over the surface of the coating.

According to the invention such pipes 1 are preferably disposed transversally to tank 3 in order to ensure the maximum spreading of the microbubbles and a homogeneous oxygenation of the emulsion.

In the mechanical industry the machine down time to replace the emulsion and to clean the tank settles the cost. Therefore, an immediate advantage of the present invention is that the machine should be stopped only for the installation of the device mentioned above. The described oxygenation device is specifically conceived to be adapted to the typical shapes of the different tanks of the machine tools without any modification of the tanks. Pipes 1 are preferably made of plastic material and then can be easily cut to fit them to the size of the tanks.

It should be noted that the life time of a well concentrated emulsion varies as a function of the kind of water used: for example, if water is very hard, the emulsion is prone to dissociate very quickly to the order of two weeks. Upon dissociation the emulsion gives out a typical, bad smell of sulphur dioxide, and its lubricating action for cooling the cutting tool fails.

A further drawback deriving from the deterioration of the emulsion is that the emulsion after dissociation becomes highly oxidative and corrosive for the guides of the machine tools, above all for framed guides not visible from the outside.

Moreover, as the disposal of the emulsion should take place according to precise anti-pollution regulations having large cost, the extension of the operating life of such cooling, lubricating liquids is particularly useful and advantageous.

The optimum oxygenation provided by the device according to the invention is independent of the thickness of the oil layer floating on the emulsion. Therefore, any disposal of oil can also be made with still standing machine by using cheaper means than the oil separator mentioned above.

It should be appreciated that the oxygenation of the cooling emulsion by the movement imparted thereto by pumps is a solution that does not overcome the problem of the separation of water and emulsifying oil. In fact, with such a solution the oxygenation is not sufficient in any case in view of the volume of the displaced emulsion. The approach of increasing the oxygenation by a faster, turbulent displacement of the emulsion does not improve the oxygenation process because the lubricating oil for the guides and the emulsion could mix together with the risk of a chemical contamination..

To sum up, it is necessary to avoid that sulphur-containing oil from the guides keeps in contact with the same portion of emulsion all the time. To this end, the device of the invention breaks the oil film and displaces the underlying portion of the emulsion so as to oxygenate it.

It is important that the installation of the oxygenation pipes 1 is well dimensioned for a correct use of the device according to the invention. To this end the pipe-lining requires that pipes 1 are anchored to the bottom of the tank, for example by magnets secured to the pipes. Moreover, the supply of compressed air may be continuous or timed, e.g. by intervals not longer than two hours, for a sufficient oxygenation.

As the air consumption corresponds approximately to a small air loss from a normal blowing gun, still another advantage of the invention is given by that the compressed air can be provided directly by the central system (if any) or by an independent blower for each machine tool which is driven during the machine down time, for example overnight, during holidays, etc.

For example, the blower may be derived by a ducted fan, an oxygenator for aquarium, a compressor for hobby, a compressor for refrigerator, etc.

The use of the device according to the invention makes the emulsion unalterable in time because moulds consisting of dead anaerobic bacteria having the density of the gelatine and attacking the emulsion to make it useless in 3–5 days since the formation of the first colonies are suppressed.

The tanks are kept clean and degreased by the device of the invention, and the emulsion still keeps the distinctive smell of the fresh composition after many months in spite of the machine down times.

A further advantage of the invention is that the emulsion is not deteriorated quickly and is not attacked by bacteria even if it is prepared at a wrong concentration, and when further emulsion is then added at a different concentration, the two compositions are blended and take an intermediate concentration.

Baffle or gate means are often applied at different heights to concentrate oil in a limited area of the tank. Such means made usually of metal sheet limits the movement of the emulsion, and then it is advisable to remove it (very easily) to achieve the best result. Finally, in case of very deep tanks, it is not necessary to anchor pipes 1 to the bottom of the tanks according to the invention but it is sufficient to secure them 20–40 cm under the surface of coolant 3 to have good oxygenation and displacement. This is particularly advantageous also in view of the fact that the air pressure of the oxygenator should be barely enough to cause the microbubbles to escape. Therefore, the greater the depth, the higher the air pressure.

The present invention has been described and illustrated according to a preferred embodiment thereof, however, it should be understood that those skilled in the art can make equivalent modifications and/or replacements without departing from the scope of the present industrial invention.

What is claimed is:

1. Apparatus for regenerating a cooling emulsion stagnating in a tank of machine tools by aeration to suppress proliferation of anaerobic bacteria, the apparatus comprising:

source of comprised air;

a plurality of aeration pipes fluidly connected to the source of compressed air and having a plurality of holes;

each pipe having an outer surface which is coated with sponge rubber layer made of a material resistant to oil components of the cooling emulsions;

each hole having the same diameter and being located along the lower generatrix of each pipe such that air escaping therefrom crosses substantially all the sponge rubber coating and establishes a uniform spreading of microbubbles; and wherein the pipes which are closer to the source of compressed air have a lower number of holes than the pipe which are remote from the source of compressed air such that the quantity of microbubbles produced by each pipe is substantially the same throughout the tank.

2. The apparatus according to claim 1, wherein each pipe has a closed first end and a second end fluidly connected to the source of compressed air.

3. The apparatus according to claim 1, wherein the pipes are located transversally to the tank in order to ensure a maximum spreading of the microbubbles and a homogenous oxygenation of the cooling emulsion.

4. The apparatus according to claim 1, wherein the pipes are made are made of plastic material.

5. The apparatus according to claim 1, wherein the pipes include magnets for anchoring the pipes to the tank.

6. The apparatus according to claim 1, wherein the source of compressed air is structured and arranged to supply air continuously or in a timed manner in intervals of not longer than two hours, for a sufficient oxygenation.

7. The apparatus according to claim 1, wherein compressed air is drawn directly from a central system.

8. The apparatus according to claim 1, wherein compressed air is supplied by an independent blower.

9. The apparatus according to claim 1, wherein in use, the pipes are secured 20–40 cm under the surface of the cooling emulsion.

* * * * *